US005454246A

United States Patent [19]

Mueller

[11] Patent Number: 5,454,246

[45] Date of Patent: Oct. 3, 1995

[54] SIDEBAR FOR CYLINDER LOCK

[75] Inventor: Charles H. Mueller, Milwaukee, Wis.

[73] Assignee: Stattec Security Corporation, Milwaukee, Wis.

[21] Appl. No.: 191,010

[22] Filed: Feb. 3, 1994

[51] Int. Cl.[6] ..... E05B 29/04

[52] U.S. Cl. ..... 70/495; 70/492

[58] Field of Search ..... 70/372, 491–496

[56] References Cited

U.S. PATENT DOCUMENTS

| | | | |
|---|---|---|---|
| 2,949,762 | 8/1960 | Johnstone | 70/495 |
| 3,695,073 | 10/1972 | Prescott | 70/366 |
| 3,733,863 | 5/1973 | Toepfer | 70/496 |
| 4,485,648 | 12/1984 | Rabinow | 70/419 X |
| 4,669,284 | 6/1987 | Prunbauer et al. | 70/276 |
| 5,209,087 | 5/1993 | Cox | 70/495 X |

FOREIGN PATENT DOCUMENTS

| | | | |
|---|---|---|---|
| 0446045 | 1/1948 | Canada | 70/495 |
| 0103532 | 3/1984 | European Pat. Off. | 70/495 |
| 4182582 | 6/1992 | Japan | 70/495 |

*Primary Examiner*—Lloyd A. Gall
*Attorney, Agent, or Firm*—Andrus, Sceales, Starke & Sawall

[57] ABSTRACT

A sidebar is provided for a mechanical lock. The lock includes a cylinder rotatable within a sleeve when a mated key is inserted in the cylinder and the key and the cylinder are rotated within the sleeve. The sidebar prevents rotation of the key and the cylinder when the mated key is not present in the cylinder. The sidebar includes a base portion and a body portion extending therefrom. The body portion has first and second opposed surfaces and at least one end. A pair of diverging chamfer surfaces extend from the end of the body portion of the sidebar. Each diverging chamfer surface intersects a distinct opposed surface on the body portion. The chamfer surfaces causes an increase in the shear strength of the sidebar so as to make forced rotation of the cylinder more difficult.

8 Claims, 2 Drawing Sheets

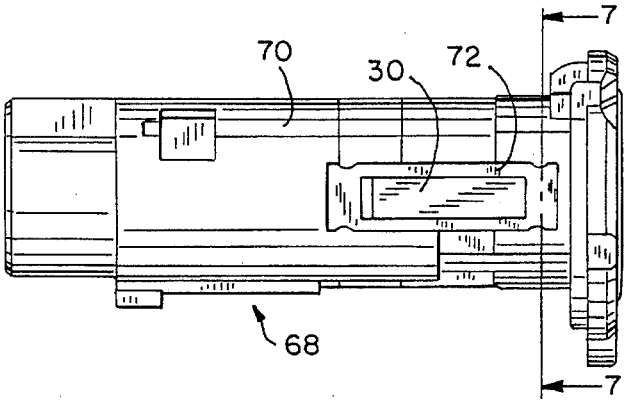
FIG. 6
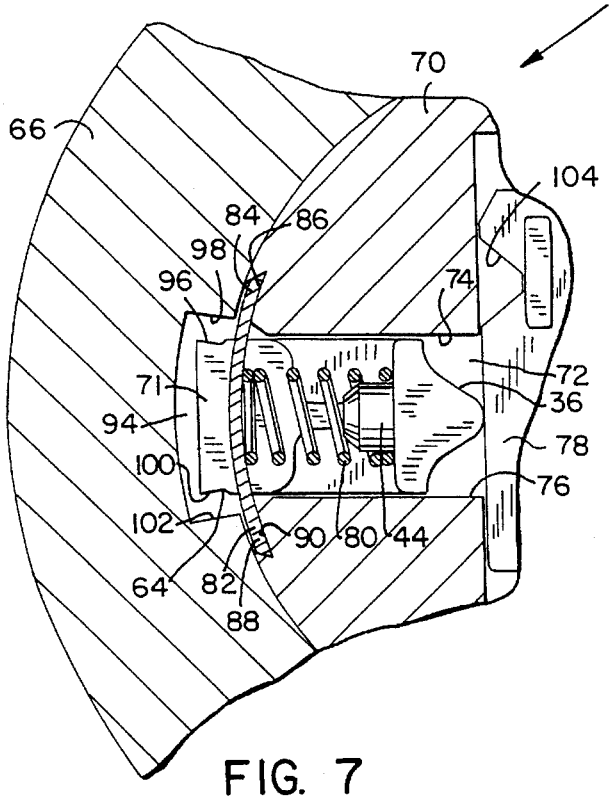
FIG. 7
FIG. 5
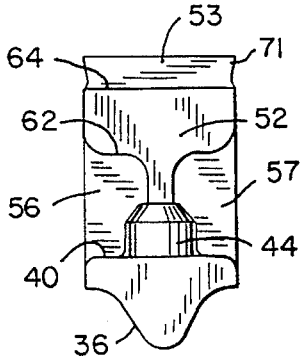
FIG. 4
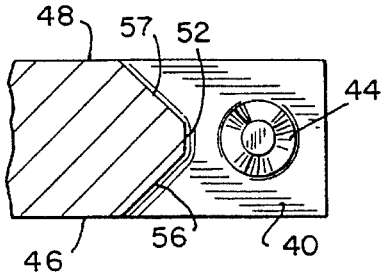
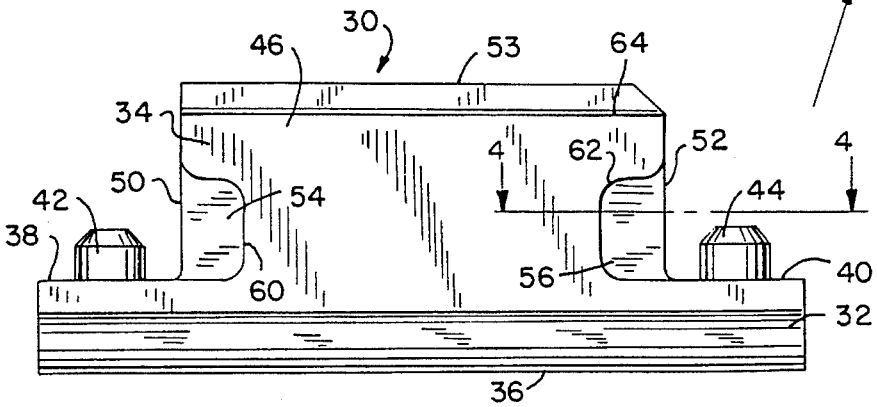
FIG. 3

SIDEBAR FOR CYLINDER LOCK

BACKGROUND OF THE INVENTION

This invention relates to a mechanical lock, and in particular, to a sidebar for preventing forced rotation of the lock cylinder.

A mechanical key lock includes a cylinder rotatably supported within a sleeve. In order to prevent rotation of the cylinder without a mated key, a sidebar is utilized. When the mated key is inserted in the cylinder, the key and the cylinder may be rotated within the sleeve.

The sidebar is placed within a slot in the cylinder and within an aligned groove in the sleeve in order to prevent the cylinder from being rotated relative to the sleeve. The sidebar is biased away from the sleeve toward the interior of the cylinder by springs. Tumblers, supported within the cylinder, maintain a portion of the sidebar within the groove in the sleeve when the mated key is not present in the cylinder.

Each tumbler includes a notched portion having reduced diameter. When the mated key is inserted in the cylinder, the notches on each tumbler align with the sidebar. As a result, the biased sidebar is urged towards the notches in the tumblers by action of the springs. If the tumblers have been properly set by the mated key, the sidebar will enter the notches in the tumblers and exit the groove in the sleeve. As a result, the cylinder is free to be rotated within the sleeve.

While present day sidebars are adequate, it is desirable to increase the shear strength of the portion of the sidebar within the groove in the sleeve. Increased shear strength makes forced rotation of the cylinder without a mated key more difficult. This, in turn, increases the lock's resistance to tampering.

In addition, it has been found that the tool steel for diecasting projections on the sidebar is prone to failure. The projections extend from the sidebar and are provided for receipt of the springs. Due to these projections on the sidebar, the tool steel will have a very thin section, which tends to wear easily and fail, thereby increasing downtime and maintenance costs.

Therefore, it is a primary object and feature of the present invention to provide a sidebar having increased shear strength in the portion of the sidebar which engages the sleeve of the mechanical key lock.

It is a further object and feature of the present invention to provide a sidebar which may be diecast by a tool which is stronger and less prone to failure.

SUMMARY OF THE INVENTION

In accordance with the present invention, a sidebar is provided for preventing forced rotation of a cylinder within a sleeve of a mechanical lock when a mated key is not present in the cylinder. The sidebar includes a base portion and a body portion extending therefrom. The body portion has first and second opposed surfaces, and first and second ends. First and second pairs of chamfer surfaces diverge from a distinct end of the body portion such that a first chamfer surface of each pair of chamfer surfaces intersects the first opposed surface, and a second chamfer surface of each pair of chamfer surfaces intersects the second opposed surface. The diverging chamfer surfaces increase the shear strength of the body portion of the sidebar, and hence, increase the lock's resistance to tampering. In addition, the very thin section of the tool steel, described previously, is made thicker in order to mold the diverging chamfer surfaces on the sidebar. As a result, the thicker section of the tool steel will fail less often so as to reduce downtime and maintenance costs.

The sleeve of the mechanical lock includes an inner surface defining a cavity therein. The inner surface is provided with a groove which is in communication with a slot extending through the cylinder. A plurality of control tumblers are supported within the cylinder. The tumblers are movable between a locked and an unlocked position. Each tumbler has a notch therein for alignment with the slot in the cylinder when the tumblers are in the unlocked position.

When the lock is assembled, the body portion of the sidebar extends into the groove on the inner surface of the sleeve so as to prevent a rotation of the cylinder relative to the sleeve. When a mated key is inserted into the cylinder, the notches in each tumbler align with the slot in the cylinder such that the tumblers are in the unlocked position. The sidebar is urged toward the interior of the cylinder whereby a part of the base portion of the sidebar is received within the notches in the tumblers, and the body portion exits the groove on the inner surface of the sleeve. As such, the cylinder is free to rotate relative to the sleeve.

BRIEF DESCRIPTION OF THE PREFERRED EMBODIMENT

FIG. 3 is a side elevation view of a sidebar in accordance with the present invention;

FIG. 4 is a cross-sectional view of the sidebar of FIG. 3 taken along line 4—4;

FIG. 5 is an end view of the sidebar of FIG. 3 in accordance with present invention;

FIG. 6 is a side elevation view of a cylinder for a mechanical lock utilizing the sidebar of FIG. 3 in accordance with the present invention;

FIG. 7 is a cross-sectional view taken along line 7—7 of FIG. 6, and includes a cross-sectional view of a portion of a sleeve placed over the cylinder of the mechanical lock;

DETAILED DESCRIPTION OF THE PREFERRED EMBODIMENT

Figure 1:
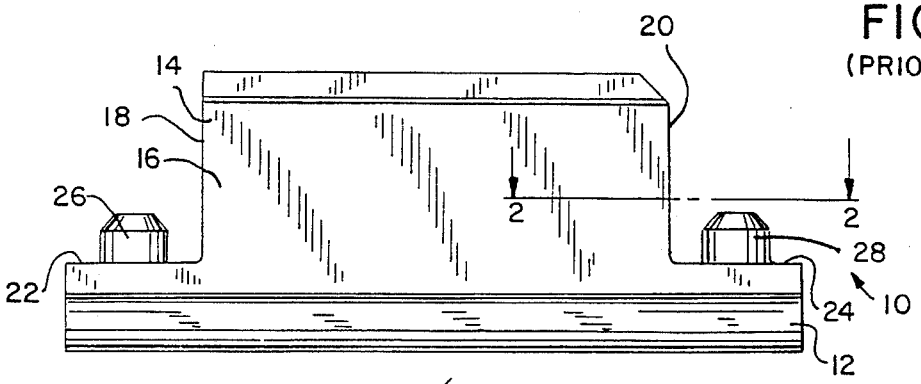
FIG. 1 (PRIOR ART)
FIG. 1 is a side elevation view of a prior art sidebar.
Figure 2:
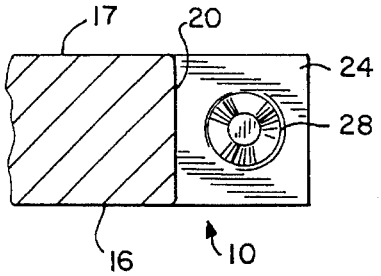
FIG. 2 (PRIOR ART)
FIG. 2 is a cross-sectional view of the sidebar of FIG. 1 taken along line 2—2.

FIG. 1 is a prior art sidebar and is generally designated by the reference numeral 10. The prior art sidebar 10 includes a base portion 12 having a body portion 14 extending therefrom. As best seen in FIGS. 1–2, the body portion 14 includes first and second opposed surfaces 16, 17 interconnected by ends 18, 20. Generally perpendicular to ends 18, 20 are the projection support surfaces 22, 24 of base portion 12. Projection 26 extends from projection support surface 22 of base portion 12, and projection 28 extends from projection support surface 24 of base portion 12. Projections 26 and 28 are used for aligning the springs which bias the sidebar 10 in the same manner as hereinafter described with respect to the present invention.

Referring to FIG. 3, the present invention is generally designated by the reference numeral 30. The sidebar 30 includes a base portion 32 along a longitudinal axis and a body portion 34 extending therefrom in a plane extending through the axis. Base portion 32 includes a tumbler engaging surface 36 and a pair of projection support surfaces 38, 40. Projections 42, 44 extend from projection support surfaces 38, 40, respectfully, of the base portion 32 of sidebar 30.

Body portion 34 includes first and second opposed surfaces 46, 48 interconnected by sides 50, 52 and by bottom 53. Side 50 of body portion 30 is perpendicular to the projection support surface 38 on the base portion 32. Similarly, side 52 is perpendicular to projection support surface 40 of base portion 32. A pair of chamfer surfaces 54, 55 (not pictured) diverge from a portion of side 50 at an acute angle relative to the plane in which body portion 34 is located, and a second pair of chamfer surfaces 56, 57, FIGS. 4–5, diverge from a portion of side 52 at an acute angle relative to the plane in which body portion 34 is located. As seen in FIG. 3, chamfer surfaces 54, 56 intersect surface 46 of sidebar 30 at edges 60, 62, respectfully. In the same manner, chamfer surfaces 55 (not pictured), 57 intersect surface 48 of sidebar 30. Chamfer surfaces 54, 55 (not pictured) diverge from each other at an angle generally equal to 90°. Likewise, chamfer surfaces 56, 57 diverge from each other at an angle generally equal to 90°.

As best seen in FIGS. 3–5 and 7, each pair of chamfer surfaces 54, 55 (not pictured) and 56, 57 extend from a portion of ends 50, 52 such that each pair of chamfer surfaces 54, 55 (not pictured) and 56, 57 remain spaced from shear line 64. Referring to FIG. 7, as hereinafter described, the section 71 of body portion 34 between shear line 64 and bottom 53 engages sleeve 66 of cylinder 68 so as to prevent rotation of cylinder 70 with respect to sleeve 66 when a mated key has not been properly inserted into cylinder 70. Each pair of chamfer surfaces 54, 55 and 56, 57 causes an increase in the shear strength of the shear section 71 of the body portion 34. If either pair of chamfer surfaces 54, 55 (not pictured) or 56, 57 extend across shear line 64, the amount of material of the sidebar 30 which prevents forced rotation of the cylinder 70 with respect to sleeve 66 is reduced. This, in turn, would proportionally reduce the shear strength of sidebar 30.

In operation, sidebar 30 is placed within slot 72, FIGS. 6–7, which is defined by sidewalls 74, 76 in cylinder 70 such that tumbler engaging surface 36 engages tumbler 78. A spring 80 is positioned about each projection 42, 44. A plate 82 is placed over each spring 80 such that a first end 84 of plate 82 engages recessed surface 86 on cylinder 70, and second end 88 of plate 82 engages a second, recessed surface 90 on cylinder 70. Each end 84, 88 of plate 82 is staked to recessed surfaces 86, 90, respectively, such that each spring 80 urges sidebar 30 toward the interior of cylinder 70. Sleeve 66 is slid over cylinder 70 such that shear section 71 of body portion 34 of sidebar 30 extends into groove 94 in sleeve 66.

As described, if one attempts to rotate the cylinder 70 clockwise with respect to sleeve 66, surface 96 of shear section 71 will engage sidewall 98 of groove 94 so as to prevent the rotation of cylinder 70. The increased shear strength of shear section 71 makes the forced rotation of cylinder 70 more difficult.

Similarly, if one attempts to turn cylinder 70 counter-clockwise with respect to sleeve 66, surface 100 of shear section 71 will engage sidewall 102 of groove 94 so as to prevent rotation of cylinder 70. As previously described, the increased shear strength of shear section 71 makes forced rotation of the cylinder 70 more difficult.

When a mated key is inserted into cylinder 70, notch 104 in tumbler 78 will align with tumbler engaging surface 36 of sidebar 30. As previously described, sidebar 30 is urged toward the interior of cylinder 70 such that a portion of tumbler engaging surface 36 will enter notch 104. Consequently, shear section 71 of sidebar 30 will exit groove 94. With shear section 71 removed from groove 94, cylinder 70 is free to rotate with respect to sleeve 66.

Figure 8:
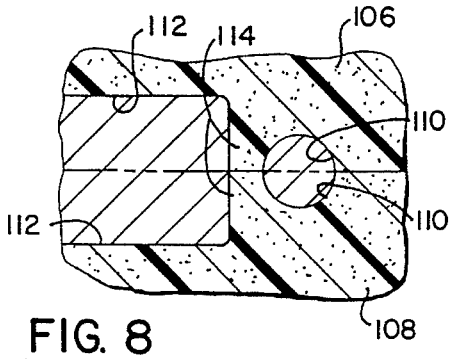
FIG. 8 (PRIOR ART)
FIG. 8 is a cross-sectional view of a portion of the mold for the prior art sidebar of FIG. 1.

In order to manufacture a sidebar, the sidebar is diecast from a pair of cooperating mold sections, known as tool steel. Each mold section is of a concave shape corresponding to a half configuration of the sidebar. Referring to FIG. 8, a portion of a pair of cooperating mold sections 106, 108 is shown. Each mold section 106,108 corresponds to a half configuration of prior art sidebar 10 and includes a mold cavity having a projection cavity portion 110 in which projection 28 is formed. Similarly, each mold cavity includes a body cavity portion 112 in which body portion 16 is formed. The portion 114 in mold sections 106, 108 between cavity portions 110 and 112 is very thin. This thin portion 114 of mold sections 106, 108 tends to wear easily and fail, thereby increasing downtime and maintenance costs.

Figure 9:
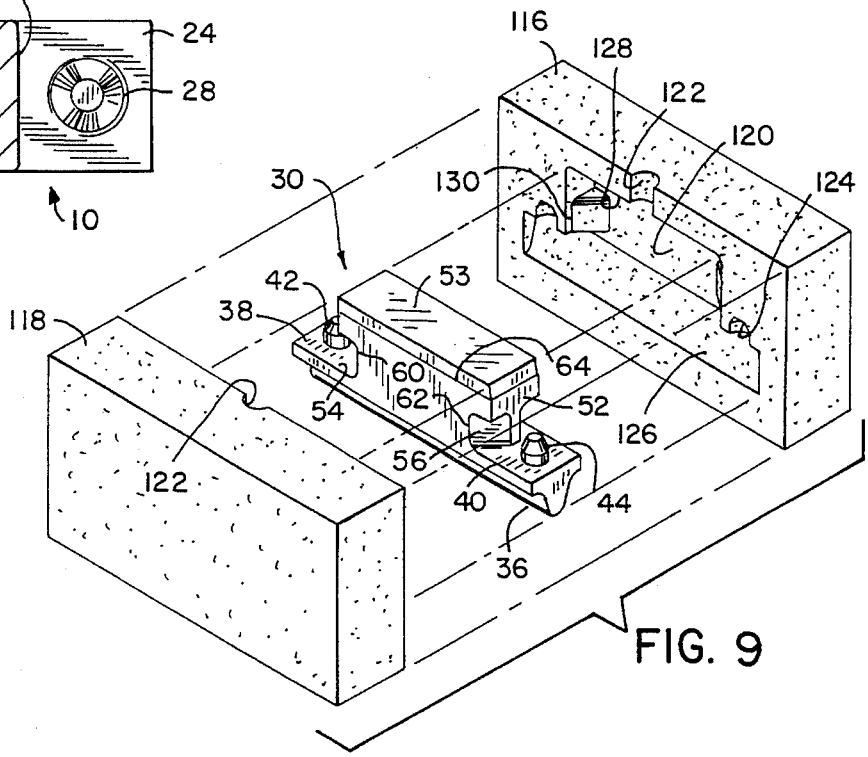
FIG. 9 is an isometric view of the mold sections which are used to form the sidebar of FIG. 3 in accordance with the present invention.

Referring to FIG. 9, as with the prior art sidebar 10, the sidebar 30 of the present invention is diecast from a pair of cooperating mold sections 116, 118. Each mold section 116, 118 includes a cavity 120 which corresponds to a half configuration of the sidebar 30 of the present invention. Passageway sections 122 in each mold section 116, 118 are joined to form a passageway in the mold wherein molten metal may be dispensed into cavity 120.

Each cavity 120 in mold sections 116, 118 includes a projection cavity portion 124. When mold sections 116, 118 are brought together, the cavity portions 124 form the section of the mold in which the projections 42, 44 are molded. In the same manner, joined base cavity portions 126 form the section of the mold in which base portion 32 of sidebar 30 is molded. Body cavity portions 128 are joined to form the section of the mold in which the body portion 34 of sidebar 30 is formed.

Figure 10:
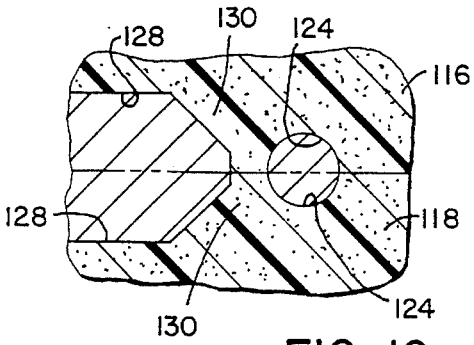
FIG. 10 is a cross-sectional view of a portion of the mold used to form the sidebar of FIG. 3 in accordance with the present invention.

As best seen in FIG. 10, the portion 130 in each mold section 116, 118 between projection cavity portion 124 and body cavity portion 128 is generally thicker in area than the portion 114 in mold sections 106, 108, FIG. 8, used to mold the prior art sidebar 10. The thicker portion 130 of mold sections 116, 118 increases the durability of each mold section 116, 118. This, in turn, decreases the downtime and the maintenance costs for production of sidebar 30. In addition, thicker portion 130 alters the flow of molten metal in mold cavity 120 so as to increase the shear strength of shear section 71.

It can be seen through the description of this invention that various embodiments are possible without deviating from the scope and spirit of this invention.

I claim:

1. A sidebar lock, comprising:

a stationary hollow sleeve member having a sidebar-receiving groove formed therein;

a cylinder rotatably supported within said sleeve member, the cylinder defining an external cylindrical surface, a longitudinal axis, and a key way along said axis for slidably receiving a key therein, and including a sidebar slot extending radially with respect to the axis from the interior of the cylinder toward the external cylindrical surface, a tumbler ward formed in said cylinder and communicating with the sidebar slot, the sidebar slot having an inner end which opens into the tumbler ward and an outer end which opens to the external cylindrical surface;

a sidebar slidably mounted within the sidebar slot for radial movement therein, the sidebar including a base having a radially inner end, a shear section having a radially outer end and a body extending between said shear section and said base, the body including first and second opposed side surfaces and first and second opposed ends, the sidebar movable between a first cylinder locking position wherein the outer end of the shear section of the sidebar projects from the cylinder into the sidebar-receiving groove of said sleeve and a second cylinder unlocking position wherein the outer end of the shear section of the sidebar is retracted within the sidebar slot;

spring means for biasing said sidebar to said unlocking position;

a pair of diverging chamfer surfaces formed at each end of the body of the sidebar, a first of each pair of chamfer surfaces extending between one end of said body and one side surface of the body of the sidebar, and a second of each pair of chamfer surfaces extending between said one end of said body and the other side surface of the body of the sidebar; and a tumbler disposed in the tumbler ward for sliding movement therein between a non-aligned position with the sidebar holding the sidebar in its cylinder locking position, and an aligned position with the sidebar permitting the sidebar to move to its cylinder unlocking position.

2. The sidebar lock of claim 1 wherein the base of said sidebar extends axially beyond the ends of the body of said sidebar to form a T-shaped sidebar that includes first and second opposite projections.

3. The sidebar lock of claim 2 wherein the spring means for biasing the sidebar includes a spring engaging each projection extending from the base.

4. The sidebar lock of claim 1 wherein the first and second chamfer surfaces of each pair of diverging chamfer surfaces diverge from each other at an angle equal to 90 degrees.

5. A sidebar for a mechanical lock, the lock having a cylinder rotatable within a sleeve when a mated key is inserted in the cylinder, the sidebar preventing rotation of the cylinder when the mated key is not present in the cylinder, the sidebar comprising:

a base portion extending along a first longitudinal axis;

a body portion projecting radially from said base portion and extending along the first longitudinal axis, said body portion including a shear section at its radially outer end;

the body portion having first and second opposed side surfaces, each side surface lying in a plane parallel to the first longitudinal axis and defining a means for radially guiding the sidebar in the cylinder between locking and unlocking positions, and first and second opposed ends, each end lying in a plane perpendicular to the first longitudinal axis; and a pair of diverging chamfer surfaces formed at each end of the body portion of the sidebar, a first of each pair of chamfer surfaces extending between a respective end of said body portion and one side surface, and a second of each pair of chamfer surfaces extending between a respective end of said body portion and the other side surface of said body portion.

6. The sidebar of claim 5 wherein said base portion further comprises first and second projections extending longitudinally beyond the ends of the body portion of said sidebar to form a T-shaped sidebar.

7. The sidebar of claim 5 wherein the first and second chamfer surfaces of each pair of diverging chamfer surfaces diverge from each other at an angle equal to 90 degrees.

8. The sidebar of claim 5 wherein the chamfer surfaces extend radially along only a portion of the radial length of the ends of said body portion.

* * * * *